US005572794A

United States Patent [19]

Kalbern

[11] Patent Number: 5,572,794

[45] Date of Patent: Nov. 12, 1996

[54] DOUBLE-EDGED KNIFE

[76] Inventor: Cindy Kalbern, 2452 Centinela, #1, Los Angeles, Calif. 90064

[21] Appl. No.: 530,567

[22] Filed: Sep. 20, 1995

[51] Int. Cl.[6] ..... B26B 9/02

[52] U.S. Cl. ..... 30/353; 30/355

[58] Field of Search ..... 30/353, 355, 340; D22/118; D7/650

[56] References Cited

U.S. PATENT DOCUMENTS

| | | | |
|---|---|---|---|
| D. 57,780 | 5/1921 | Lickert . | |
| D. 166,880 | 5/1952 | Ruppe | 30/355 |
| D. 213,388 | 2/1969 | Hopcraft . | |
| D. 269,244 | 6/1983 | Becher et al. | 30/355 X |
| D. 275,065 | 8/1984 | Steiner . | |
| D. 314,490 | 2/1991 | Elie . | |
| 1,040,138 | 10/1912 | Buck . | |
| 2,234,242 | 3/1941 | Gilbert . | |
| 2,315,898 | 4/1943 | Krilow | 30/355 X |
| 2,606,364 | 8/1952 | Gustafson . | |
| 2,814,870 | 12/1957 | Treiber . | |
| 3,205,575 | 9/1965 | Senkewitz | 30/355 |
| 3,279,065 | 10/1966 | Senkewitz | 30/355 |
| 4,178,684 | 12/1979 | Mightly . | |

*Primary Examiner*—Douglas D. Watts

*Attorney, Agent, or Firm*—Poms, Smith, Lande & Rose

[57] ABSTRACT

A knife including a handle, a blade body, a first cutting surface associated with one edge of the blade body adapted for slicing bread and a second cutting surface associated with the other edge of the blade body adapted for scraping and spreading butter or the like.

10 Claims, 2 Drawing Sheets

DOUBLE-EDGED KNIFE

BACKGROUND OF THE INVENTION

1. Field of the Invention

This invention relates generally to knives.

2. Description of the Related Art

Culinary knives have long been available with a myriad of blade types, each designed to perform a different operation on food products. Typically, a knife performs only one operation, such as meat-cleaving, fruit-peeling, bread-slicing or spreading butter, jam, peanut butter, cream cheese and other spreads. Thus, in order to perform more than one function, more than one knife was needed. Some special-purpose knives have been designed to perform more than one operation. For example, U.S. Pat. No. 1,040,138, issued to Buck in 1912, discloses a fishing knife with multiple edges. One edge performs a cutting function, another edge performs a scaling function, and a third edge performs a scraping function to clean the insides of a fish.

When preparing a slice of bread with butter or another spread, several steps are required. One must slice the loaf of bread with a bread knife having relatively large serrations, put the bread knife aside, and then select a butter knife having smaller serrations, and often a rounded tip, for scraping the spread from its container and spreading it onto the slice. Using a plurality of knives, however, has several drawbacks. First, alternating knives is inconvenient, particularly when the multiple steps described above are repeated several times during preparation of a large number of buttered bread slices. Second, since more than one knife becomes soiled, extra utensil washing is required. Additionally, increased knife handling increases the risk of injury to the user. The Buck knife and other knives fail to provide a solution to these common inconveniences that face many people on a daily basis. Accordingly, a need exists for a knife that can both slice bread and spread a spread onto the sliced bread.

A further drawback associated with conventional butter knives is the difficulty one may encounter when scraping hard butter from its container and then spreading it onto the bread. When grasping a knife handle in a fist-like orientation, the user may not have the leverage needed for controlled scraping and spreading. Instead of scraping thin layers of spreadable butter from the container onto the butter knife, a chunk of butter may accidentally break off. The index finger of the hand that holds the knife, if extended onto blade portion of the knife, can function as a lever to provide greater control of the lateral scraping and spreading action performed on hard butter or the like. However, conventional butter knives do not provide a dedicated location upon which the tip of an index finger may be strategically placed for maximum knife control when scraping and spreading in a lateral, or sideways, motion. Although the tip of an index finger may be placed onto the handle or smooth face of the blade of any conventional butter knife to gain better leverage, such practice may be uncomfortable and risks injury to the finger or hand as the finger may slip off of the knife while scraping or spreading. Accordingly, a need also exists for a knife that facilitates improved control of the knife when scraping and spreading spreads.

SUMMARY OF THE INVENTION

The general object of the present invention is to provide a knife that obviates, for practical purposes, the aforementioned problems in the art. In particular, one object of the present invention is to provide a knife that is capable of performing more than one function. Another object of the present invention is to provide a knife that is capable of both slicing bread and spreading spreads. A further object of the present invention is to provide a knife that facilitates safe and controlled scraping and spreading of hard spreads.

In order to accomplish these and other objectives, a number of preferred embodiments of the present invention include a handle, a blade body defining opposing longitudinal ends and opposing edges, and cutting surfaces associated with the edges. In accordance with one preferred embodiment, one cutting surface has relatively large serrations and is adapted to slice bread and another cutting surface has relatively small serrations and is adapted to scrape and spread spreads. In accordance with another preferred embodiment, a finger depression is provided on the blade body for receiving an index finger.

The present invention provides a number of advantages over the prior art. For example, having two edges on the same knife, one for slicing bread and the other for scraping and spreading a spread, eliminates the need for two knives to perform these complementary functions. A loaf of bread is first sliced using the cutting surface having the large serrations and then, conveniently and efficiently, by simply rotating the knife, the slices may be buttered using the cutting surface having the smaller serrations on the other side of the blade. The reduced knife handling decreases the risk of injury to the user, and, as only one knife becomes soiled, less utensil washing is involved. An additional benefit of the present invention is that the use of the strategically located finger depression improves the user's ability to control the knife, thereby reducing the likelihood of injury or accidentally digging a chunk of hard butter from its container when attempting to scrape the butter onto the knife. Furthermore, smooth spreading of solid butter or other spreads from the knife onto the bread is more readily achieved with the use of the finger depression.

The foregoing and other features and attendant advantages of the present invention will be apparent from a consideration of the following detailed description of the invention when considered in conjunction with the accompanying drawings.

DESCRIPTION OF THE PREFERRED EMBODIMENTS

The following is a detailed description of a number of preferred embodiments of the present invention. This description is not to be taken in the limiting sense, but is made merely for the purpose of illustrating the general principles of the invention. The scope of the invention is defined by the appended claims.

Figure 1:
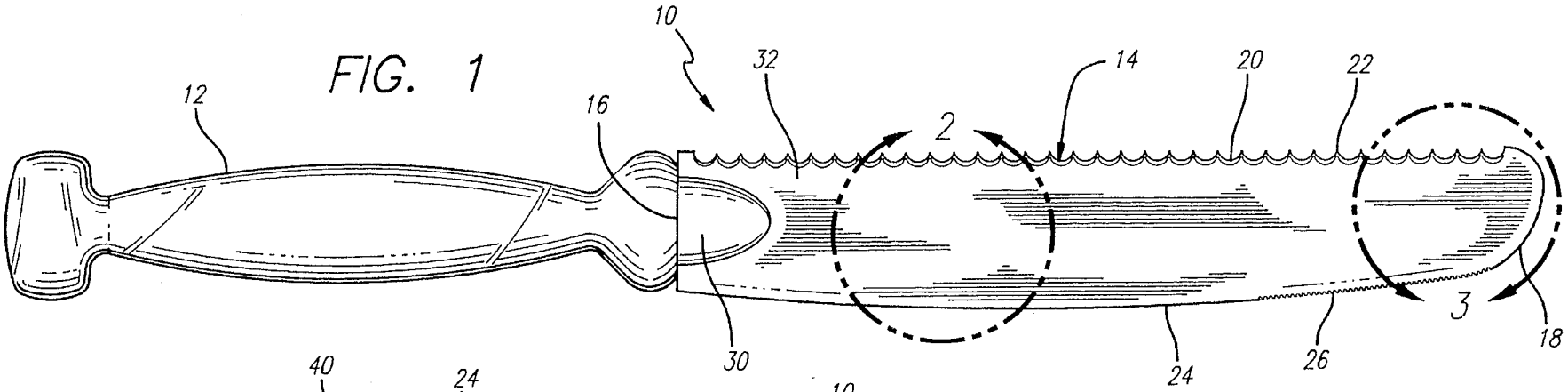
FIG. 1 is a side view of a double edged knife in accordance with a first preferred embodiment of the present invention.

Referring to FIG. 1, a knife 10 is shown having a handle 12 and a blade body 14. A first end 16 of the blade body 14 may be fixed to the handle 12 by conventional methods such as welding, gluing or encasing. Alternatively, the blade body 14 may have an integral shank portion (not shown) extending from the first end 16 that is received by a cavity in the handle 12. Fasteners, such as rivets or bolts, may secure the shank portion of the blade body 14 to the handle 12. The shank portion may also screw into the cavity. The handle 12 may be wood, plastic, metal or any other acceptable material. The blade body 14 is preferably made of stainless steel, but may be made of other suitable materials, such as sterling silver or plastic.

In accordance with the preferred embodiment illustrated in FIG. 1, the blade body 14 includes a top edge 20 and a bottom edge 24, both extending from the first end 16 to an opposed free end 18. The free end may be rounded. A first cutting surface having relatively large teeth or serrations 22 traverses along substantially the entire top edge 20. The shape and size of the relatively large serrations 22 on the first cutting surface, which is shown in detail in FIG. 2 and described more fully below, are optimized for slicing a loaf of bread. A second cutting surface 26 having relatively small serrations 28 extends substantially from the opposed free end 18 along a portion of the bottom edge 24. In this embodiment, the second cutting surface 26 extends for approximately one-fourth of the distance along the bottom edge 24. The size and shape of the small serrations 28 on the second cutting surface 26, as shown in detail in FIG. 3 and described below, are optimized for scraping butter, margarine, jam, cream cheese and other spreads from a container and for spreading the spreads onto sliced bread. It should be noted, however, that this configuration may be reversed such that the relatively large serrations 22 are on the bottom edge and the relatively small serrations 28 are on the top edge.

A finger depression 30 having a concave, semi-oval shape may be located on the right surface or face 32 of the blade body 14, close to the first end 16 of the blade body 14. The size and location of the finger depression 30 is optimized for receiving the tip of an extended index finger of a right hand that clutches the knife handle 12. The extended finger provides leverage and control when scraping and spreading hard butter or the like. The finger depression may be located on the left face of the blade body for left-handed persons, or may be placed on both the left and right faces of the blade body for use by either left-handed or right-handed persons. The handle may also be specially adapted for use by either left-handed or right-handed persons.

In the exemplary embodiment illustrated in FIG. 1, the handle 12 is approximately four and one-quarter inches long. The length of the blade body 14, extending from the first end 16 to the opposed free end 18, is approximately five and three-quarters inches long. The width of the blade body 14, extending from the top edge 20 to the bottom edge 24 is between approximately three-quarters of an inch and approximately one inch. The preferred blade body 14 also defines a substantially rectangular shape.

Figure 2:
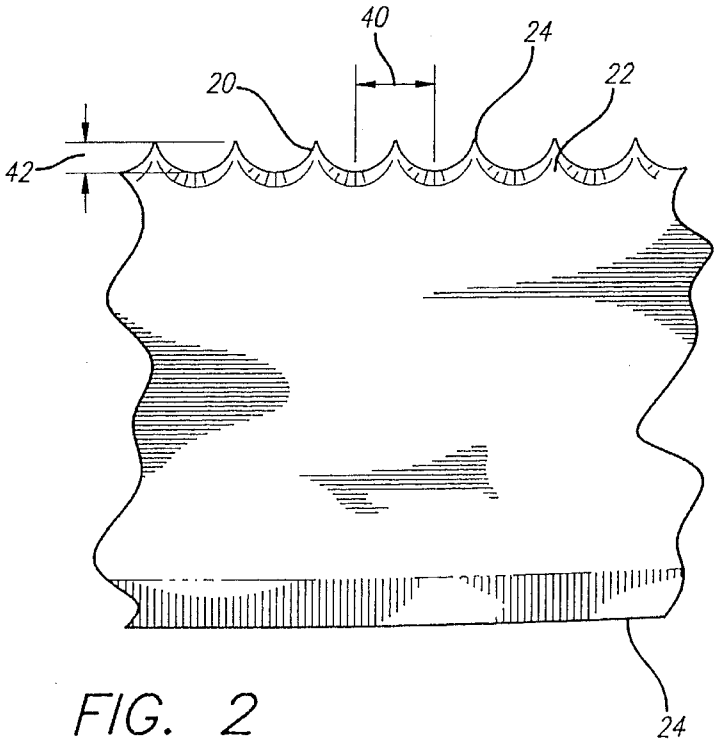
FIG. 2 is an enlarged partial side view of a first cutting surface of the knife illustrated in FIG. 1.
Figure 4:
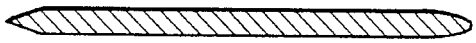
FIG. 4 is a cross-section view taken along line 4—4 in FIG. 3.

Referring now to FIG. 2, an enlarged side view of one example of the first cutting surface on the top edge 20 is shown. Each uniformly shaped and sized tooth or serration 22 is approximately three-sixteenths of an inch long (see arrow 40). That is, there are approximately six teeth or serrations per inch. The curve extending from the tip or apex 24 of each serration to the apex of an adjacent serration defines a substantially arcuate shape. The preferred height of each serration, measured from the apex to the deepest portion of the arc is approximately three thirty-seconds of an inch (see arrow 42). As shown in FIG. 4, the cutting surface 20 may be edged on one or both sides so that the serrations 22 are sharp enough to easily break the surface of and slice through a loaf of bread.

Figure 3:
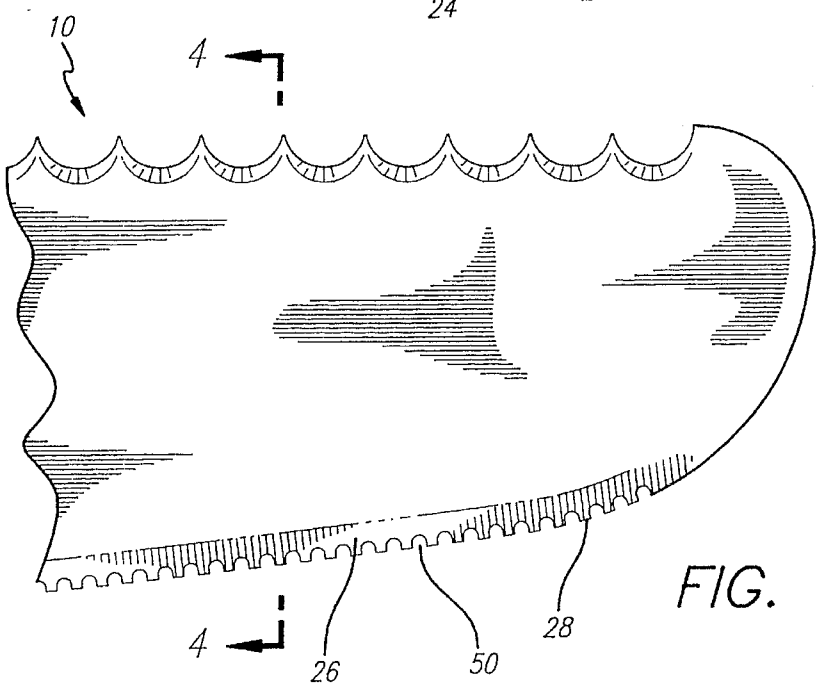
FIG. 3 is an enlarged partial side view of a second cutting surface of the knife illustrated in FIG. 1.

Turning now to FIG. 3, an enlarged view of one example of the second cutting surface 26 is shown. The relatively small serrations 28 that comprise the second cutting surface 26 are formed by boring a plurality of evenly-spaced, minute, arcuate-shaped notches 50 out of the bottom-edge 24. In this embodiment, there are approximately twenty to twenty five small serrations 28 per inch. The notches defining the small serrations 28 are each preferably approximately two-tenths of an inch deep, but may range from approximately four-hundredths of an inch to one-eighth of an inch deep. This preferred configuration offers ideal scraping and spreading characteristics.

Figure 5:
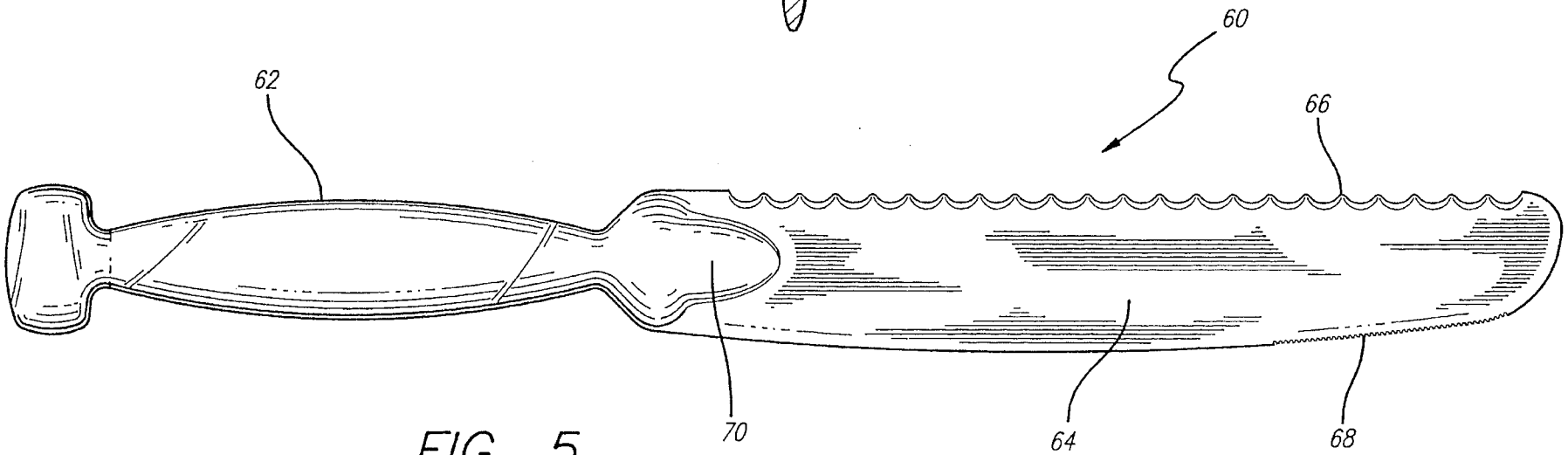
FIG. 5 is a side view of a double edged knife in accordance with a second preferred embodiment of the present invention.

FIG. 5 shows a second embodiment of the present invention. Here, a knife 60 is constructed such that the blade and handle are unitary. Specifically, the knife 60 is not constructed by attaching a handle 62 to a separate blade body 64 but is instead machined, cast or otherwise formed from a single piece of material, such as stainless steel. Cutting surfaces 66 and 68, as well as a finger depression 70, are machined or otherwise formed onto the knife 60 either at the time of formation or in separate steps.

Although the present invention has been described in terms of the preferred embodiments above, numerous modifications and additions to the above-described preferred embodiments would readily be apparent to one skilled in the art.

Thus, by way of example and not limitation, the size of the knife and its components may vary. Specifically, the size of the handle may range from less than three inches to greater than six inches long. The blade body length may also range from less than four inches to greater than eight inches long and is not limited to a rectangular shape. Further, configuration of the teeth or serrations on the first and second cutting surfaces may range in length, depth, shape, uniformity and sharpness. Alternatively, either or both of the cutting surfaces may be smooth, or without serrations, along all or a portion of the surfaces. Also, the degree of sharpness of the smooth surface(s) may vary. Although the first cutting surface optimally extends for the entire length of the top edge, it may alternatively extend along a portion less than the entire edge distance. The length of the second cutting surface may also range from less than one-fourth of the length of the bottom edge to greater than one-half its length.

Furthermore, the present invention is not limited to knives typically found in the kitchen. Smaller versions may be created for use during travel or camping. Such a knife could take the form of either a down-sized version of the knife shown in FIG. 1 or a version where the double edged blade pivots into the handle for compactness.

It is intended that the scope of the present invention extends to all such modifications and additions and that the scope of the present invention is limited solely by the claims set forth below.

What is claimed is:

1. A knife, comprising:

a handle;

a blade body associated with the handle defining a left face and a right face and including a first longitudinal end substantially adjacent to the handle, a second longitudinal free end, a first edge defining a length extending substantially from the first longitudinal end to the second longitudinal free end, and a second edge defining a length extending substantially from the first longitudinal end to the second longitudinal end and a second surface mid-point;

a first cutting surface associated with the first edge and extending along substantially the entire length of the first edge;

a second cutting surface associated with the second edge and extending from approximately the second longitudinal free end to a predetermined point located substantially between the second surface mid-point and the second longitudinal free end;

a substantially smooth surface associated with the second edge and extending from the predetermined point to the first longitudinal end; and a finger depression located on at least one of the left face and right face of the blade body and substantially adjacent to the first longitudinal end.

2. A knife as claimed in claim 1, wherein the blade body defines a substantially rectangular shape.

3. A knife as claimed in claim 1, wherein the predetermined point is located approximately one-half the distance between the second surface mid-point and the second longitudinal free end.

4. A knife as claimed in claim 1, wherein the finger depression defines a substantially oval and concave shape.

5. A knife as claimed in claim 1, wherein the handle and the blade body comprise the same material.

6. A knife as claimed in claim 5, wherein the handle and blade body comprise stainless steel.

7. A knife as claimed in claim 5, wherein the handle and the blade body are integrally formed.

8. A knife as claimed in claim 1, wherein the second longitudinal free end defines a substantially rounded shape.

9. A knife as claimed in claim 1, wherein the first edge defines a top edge and the second edge defines a bottom edge.

10. A knife, comprising:

a handle;

a blade body defining a substantially rectangular shape having a left face and a right face, a first longitudinal end substantially adjacent to the handle, a second longitudinal free end defining a substantially rounded shape, a top edge extending substantially between the first longitudinal end and the second longitudinal free end, and a bottom edge substantially between the first longitudinal end and the second longitudinal end;

a first cutting surface associated with substantially the entire top edge and defining relatively large and uniformly sized and shaped serrations, wherein:

a) each relatively large serration includes an upwardly extending portion terminating in a substantially sharp apex and an arcuate-shaped portion, b) there are approximately six relatively large serrations per inch, and c) the height of each relatively large serration is approximately three thirty-seconds of an inch;

a second cutting surface associated with the bottom edge, extending from the second longitudinal free end along one-fourth of the bottom edge and defining relatively small serrations and arcuate-shaped notches, each notch being approximately two-tenths of an inch deep and the notches and relatively small serrations being dimensioned such that there are approximately twenty five relatively small serrations per inch; and a finger depression defining a substantially oval and concave shape and located on at least one of the left face and right face of the blade surface and substantially adjacent to the first longitudinal end.

* * * * *